US006595195B1

(12) United States Patent
Barner et al.

(10) Patent No.: US 6,595,195 B1
(45) Date of Patent: Jul. 22, 2003

(54) ARROW REST DEVICE

(75) Inventors: Roland K. Barner, Bozeman, MT (US); Michael Ellig, Bozeman, MT (US)

(73) Assignee: Montana Black Gold, Bozeman, MT (US)

( * ) Notice: Subject to any disclaimer, the term of this patent is extended or adjusted under 35 U.S.C. 154(b) by 0 days.

(21) Appl. No.: 10/052,070

(22) Filed: Jan. 18, 2002

(51) Int. Cl.[7] ..... F41B 5/22
(52) U.S. Cl. ..... 124/44.5
(58) Field of Search ..... 124/24.1, 44.5

(56) References Cited

U.S. PATENT DOCUMENTS

| | | | | | |
|---|---|---|---|---|---|
| 4,287,868 | A | * | 9/1981 | Schiff | |
| 4,344,409 | A | | 8/1982 | Barner | |
| 4,907,566 | A | * | 3/1990 | Klein | |
| 4,953,521 | A | * | 9/1990 | Troncoso et al. | 124/24.1 |
| 5,150,700 | A | * | 9/1992 | Troncoso | 124/44.5 |
| 5,179,930 | A | * | 1/1993 | Simo | 124/44.5 |
| 5,601,069 | A | * | 2/1997 | Clark | 124/44.5 |

OTHER PUBLICATIONS

Bow & Arrow Hunting advertisement "Savage"; Sep. 2000; p. 15 and p. 90.
"Premier Series", Color Brochure pp. 3–4.
Trophy Taker "Arrow–Rest"; Brochure pp. 1–4; DeBorgia, Montana.

* cited by examiner

*Primary Examiner*—John A. Ricci
(74) *Attorney, Agent, or Firm*—Shook, Hardy & Bacon, L.P.

(57) ABSTRACT

The present invention is an fall-away arrow rest for an archery bow. It is comprised of a housing having a cavity. A shaft extends into the housing and is rotatable between a set position and a release position. A shaft pin is coupled with the shaft that extends away from the shaft and into the cavity. A first spring is provided to urge the shaft towards the release position. A weight is coupled with the housing and positioned in the cavity so that it can pivot between a locking position and an unlocking position with the weight being biased with a second spring towards the locking position. A pin stop is provided in the weight to receive the shaft pin when the shaft is in the set position and the weight is in the locking position. An arrow support is coupled with the shaft portion that extends outside of the housing. A cover is supplied across the cavity to prevent the entry of deleterious materials. The present invention thus provides an improved fall-away arrow rest that is enclosed to prevent entry of deleterious materials. The present arrow rest also has an easily accessible sensitivity adjustment to enable the arrow rest to improve operation of the arrow rest over a wide range of bow strengths.

20 Claims, 5 Drawing Sheets

ARROW REST DEVICE

STATEMENT REGARDING FEDERALLY SPONSORED RESEARCH OR DEVELOPMENT

Not Applicable.

CROSS-REFERENCE TO RELATED APPLICATIONS

Not Applicable.

FIELD OF USE

This invention relates to archery bows and more particularly to an improved arrow rest.

BACKGROUND OF THE INVENTION

Archery is a sport enjoyed by target-shooters and hunters alike. Numerous archery ranges attest to archery's popularity for target shooting. In addition, many states offer a hunting season for bow hunters only that is often limited in duration and/or in the number of participants. Such limitations, coupled with a hunter's normal aspirations, place an increased emphasis on archery skills to ensure a successful hunt during the time allowed.

An important archery requirement is the ability to stabilize the arrow upon release of the bow string. At an earlier time, the archer rested the arrow on the hand holding the bow. While this method lent some stability to the arrow upon release, it was prone to inaccuracy. Mechanical arrow rests were thereafter developed to better support the arrow and thereby to provide improved arrow stabilization during the important release stage. Early arrow rests provided a fixed support that, although offering somewhat more stabilization, often interacted with the arrow shaft or fletching upon release. Such interaction could cause an arrow to deviate from its intended flight path. Since arrow velocities often exceed 270 feet per second, any interference between the fletching and the arrow rest, after release, reduces the accuracy of the shot and the penetration of the arrow at its target.

Movable arrow rests were developed primarily to reduce unwanted interaction between the arrow rest and the fletching. A moveable arrow rest supports the arrow until released and then drops quickly away from the arrow upon release, thereby allowing the fletching to clear the arrow rest. One type of moveable arrow rest relies on a linkage, such as a cord or rubber tubing, tied between the arrow rest and the bow string or cable. Drawing the bow pulls the linkage and thereby lifts the arrow rest into the set position. Releasing the bow string relaxes the linkage and allows the arrow rest to fall to a release position by means of gravity or a spring mechanism. Such arrow rests often expose the linkage and other operating mechanisms. Since many hunters conceal themselves in dense forests, foliage and undergrowth, these designs could be disadvantageous because the externally exposed mechanism could be damaged in such an environment causing the arrow rest to malfunction.

An inertial moveable arrow rest is shown in U.S. Pat. No. 4,344,409 and incorporated herein by reference. The inertial arrow rest takes advantage of a sharp movement of the bow near the handle, in the opposite direction of the arrow's flight path, that occurs upon arrow release. Such an arrow rest eliminates the need for a cumbersome linkage between the arrow rest and the bow string. The bow handle's backward movement effects the quick dropping of the rest, thereby allowing it to move out of the arrow's flight path. The arrow rest shown in U.S. Pat. No. 4,344,409 further disclosed a set screw positioned so as to contact the weight arm and thereby to provide some adjustment for the arrow rest. Adjustment of the set screw operated to vary the travel of the weight arm to allow the arrow rest to release at a desired point.

While this inertial arrow rest and similar models were a step forward, the exposed moving parts presented disadvantages in the field as they are often bent or broken by contact with branches and brush or they are prone to collect dirt or other deleterious materials thereby interfering with proper operation. Moreover, in the field, the adjustment set screw did not always provide the arrow rest mechanism with a constant starting point and thereby could limit the ability of the arrow rest to perform consistently over a large number of shots.

SUMMARY OF THE INVENTION

To address these and other needs, the present invention provides a fall-away arrow rest that is adjustable and fully enclosed to assure trouble-free operation of the moveable parts of the associated mechanism. The present invention provides a housing having a cavity. A shaft extends into the housing and is rotatable between a set position and a release position. The shaft is provided with a shaft pin that extends away from the shaft and into the cavity. A first spring is provided to urge the shaft towards the release position. A weight is positioned in the cavity and rotatably coupled with the housing, enabling the weight to pivot between a locking position and an unlocking position. A pin stop is coupled with the weight to receive the shaft pin when the shaft is in the set position and the weight is in the locking position. A second spring is also provided to urge the weight towards the locking position. An arrow support is positioned on a portion of the shaft extending outside of the housing. A cover is coupled with the housing across the cavity in order to shield the moving parts therein. The arrow rest is mounted on a bow near the handle using bolts or other mounting means.

To use the arrow rest of the present invention, the archer rotates the arrow support upwardly into the set position and places an arrow thereon. The bow string is drawn, and when released, the bow handle experiences a backward movement opposite the arrow's flight path. Being coupled with the bow, the arrow rest moves with the bow in the same backward motion. However, the weight is pivotably coupled with the arrow rest housing, and upon arrow release, the mass of the weight causes the weight to momentarily resist rotation about its pivotal axis while the housing continues to move. The weight thus momentarily becomes positioned in the unlocking position with respect to the housing, thereby releasing the shaft pin from the pin stop. The biased shaft then quickly rotates toward the release direction thereby causing the arrow support to fall into the release position in time to avoid the fletching of the released arrow as it clears the bow.

It can be readily seen that the present invention enables an archer to have an improved fall-away arrow rest that is adjustable and less subject to interference and damages when used in the field. Additional features and advantages of the invention are made apparent from the following detailed description of the invention which proceeds with reference to the accompanying drawings.

BRIEF DESCRIPTION OF DRAWINGS

The present invention is described in detail below with reference to the attached drawing figures, wherein.

DETAILED DESCRIPTION OF THE INVENTION

Figure 1:
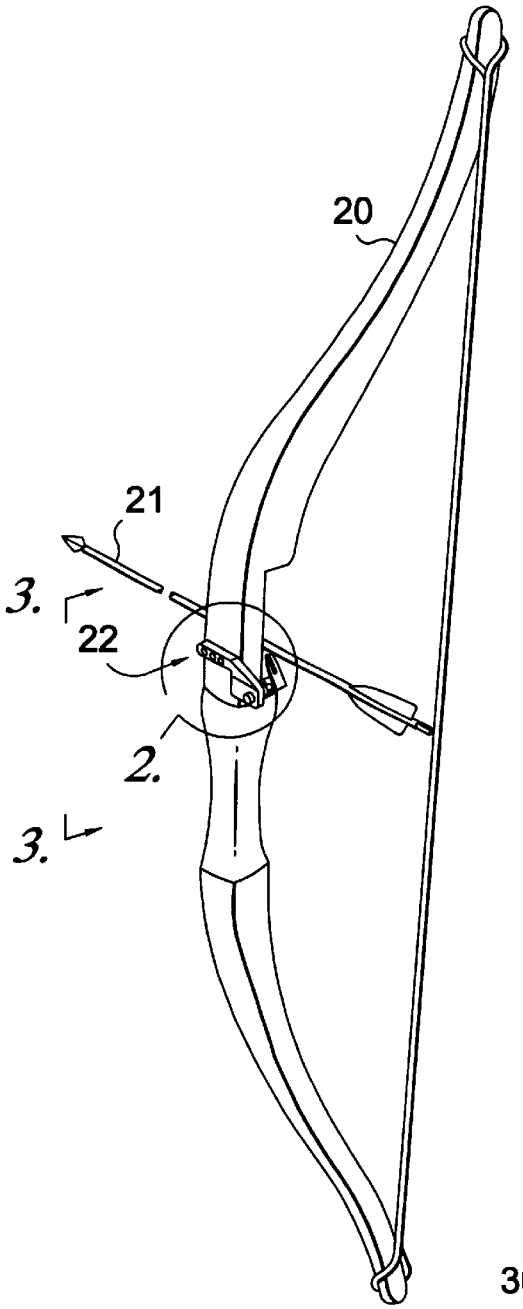
FIG. 1 is a perspective view of an archery bow incorporating the arrow rest of the present invention.
Figure 2:
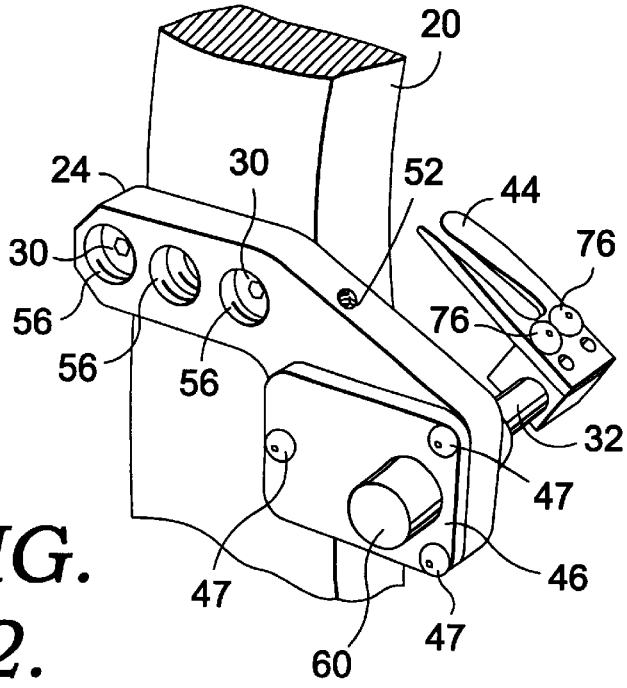
FIG. 2 is an enlarged fragmentary perspective view of the archery bow taken within the circle designated by the numeral 2 in FIG. 1, showing the arrow rest in greater detail.

Referring to the drawings in greater detail, an archery bow 20 and arrow 21 are shown generally in FIG. 1 along with the arrow rest 22 of the present invention. Arrow rest 22 is mounted to bow 20 as shown in more detail in FIG. 2 by means of mounting bolts 30 extending into bow 20 through threaded holes 56 in a housing 24. As will be appreciated by those skilled in the art, many other methods could be employed to secure arrow rest 22 to bow 20, such as with an adhesive material or with a press-fit configuration in an aperture on the bow.

Figure 3:
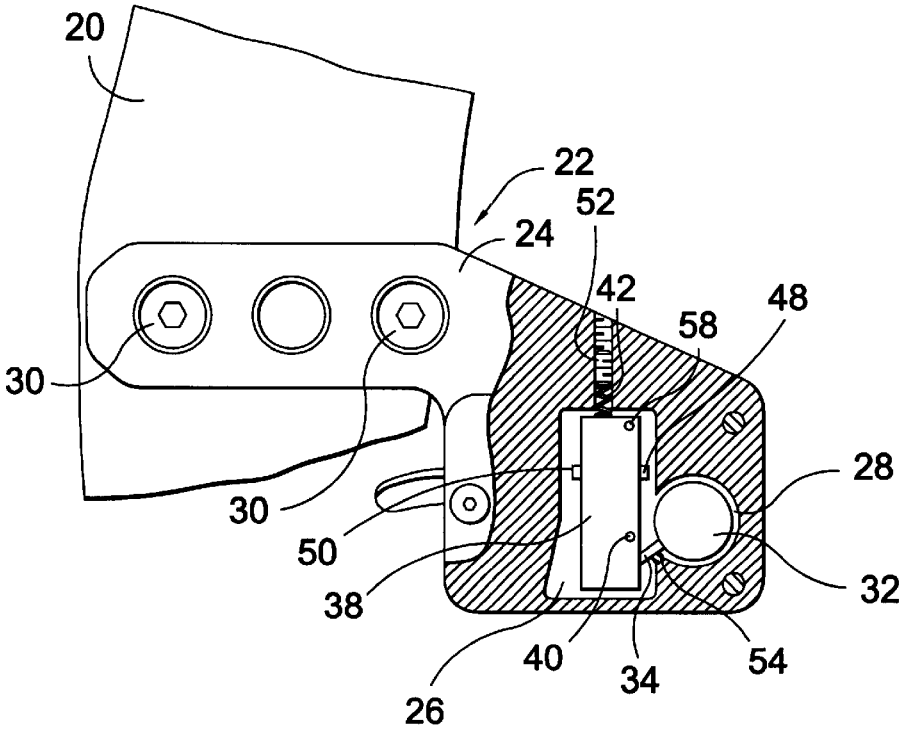
FIG. 3 is an enlarged fragmentary side elevation view of the arrow rest taken generally along the line 3—3 of FIG. 1, illustrating the arrow rest in the release position, with portions of the housing broken away.
Figure 4:
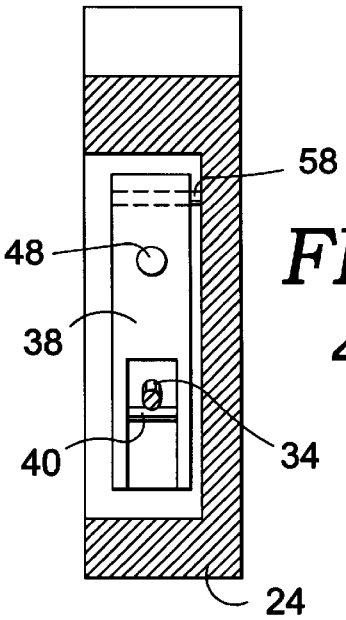
FIG. 4 is an enlarged fragmentary elevation of the housing and weight portion of the arrow rest taken generally along the line 4—4 in FIG. 8 with portions of the housing and the shaft pin broken away.

FIG. 3 further illustrates arrow rest 22 of the present invention. Arrow rest 22 is comprised of the housing 24 having a cavity 26 and a shaft aperture 28. Shaft aperture 28 may extend into housing 24 and be positioned to intersect a portion of cavity 26. Although shaft aperture 28 is shown herein as passing completely through the housing, other configurations are possible, such as having shaft aperture 28 extend into one side only of housing 24 without exiting through an opposite side. Housing 24 may be constructed of aluminum or other suitable lightweight metal and supplied with a finish suitable for the intended environment of use, such as a dark finish for hunting purposes to avoid detection in the field.

Figure 8:
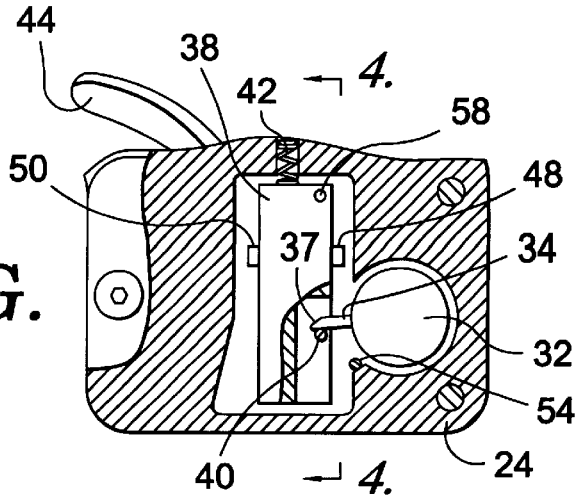
FIG. 8 is a fragmentary side elevation view of the present invention, illustrating the position of the shaft, shaft pin, pin stop and weight when the arrow rest is in the set position.
Figure 5:
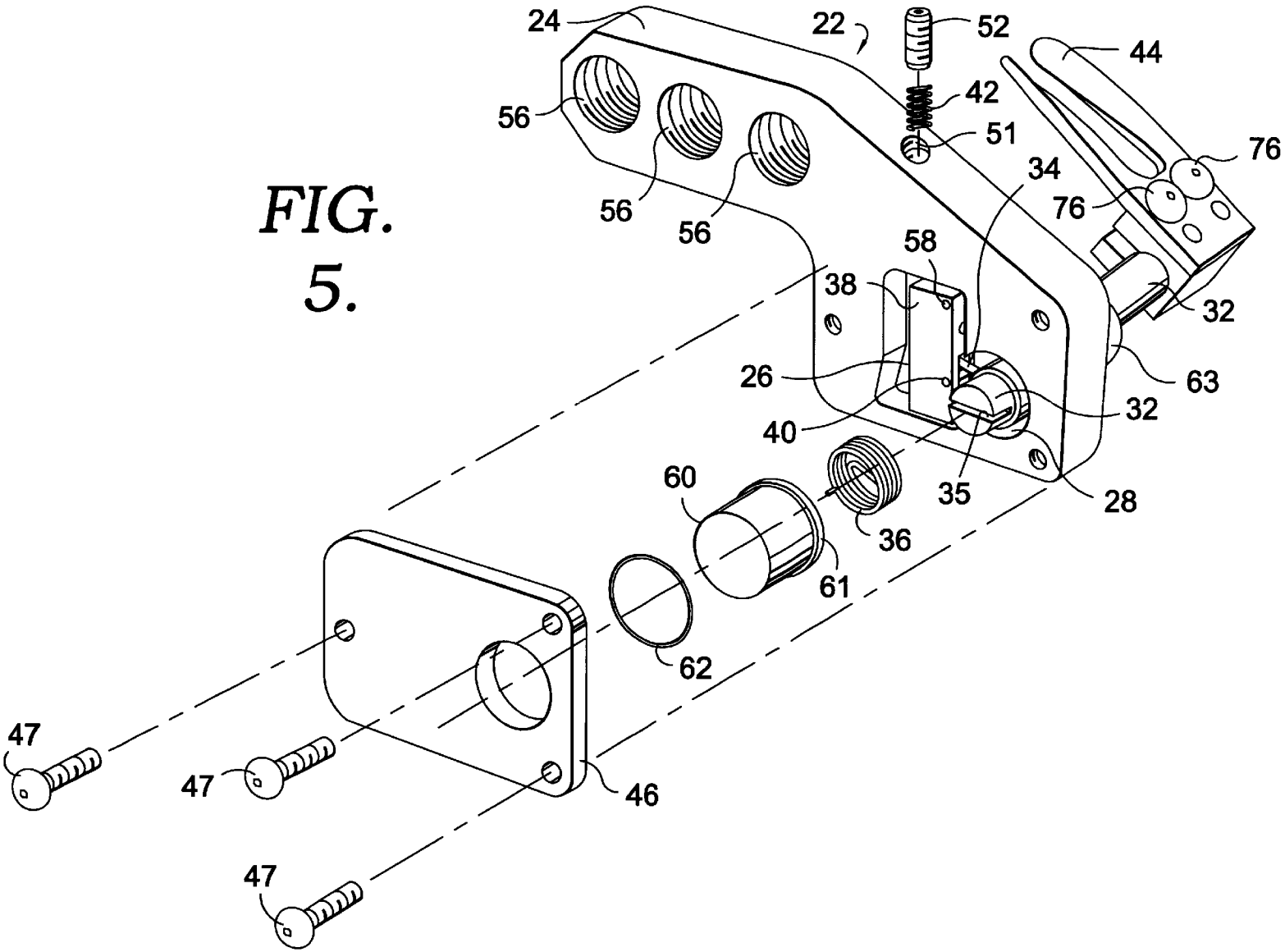
FIG. 5 is an exploded front perspective of the present invention.

A shaft 32 extends into housing 24 at shaft aperture 28. Shaft 32 is rotatable between a set position, as illustrated in FIG. 8, and a release position, as illustrated in FIG. 3. A shaft pin 34 is coupled with shaft 32. Shaft pin 34 extends away from shaft 32 and into cavity 26 to terminate in a distal end 37 as shown in FIG. 8. Pin rest 54 may be supplied to receive shaft pin 34 when shaft 32 is in the release position. As shown in FIG. 5, a slot 35 is provided in an end of shaft 32 for receiving a first spring, 36, such as a torsion spring, for urging shaft 32 toward the release position. Shaft 32 may be a standard stainless steel or other metal shaft. Shaft pin 34 is constructed of hardened metal and may have a cylindrical, rectangular or other profile. In addition, a top edge of shaft pin 34 is preferably recessed along its longitudinal axis proximate the distal end 37 as illustrated in FIG. 8. Pin rest 54 may be constructed of an elastomeric material, such as rubber, that is cylindrical in shape. As will be understood by those skilled in the art, the first spring may be implemented through a variety of configurations, such as a coil spring or other arrangement, without requiring a slotted shaft configuration.

A weight 38 is positioned in cavity 26 and pivotably coupled with housing 24 by pivot pin 58 for rotation between a locking position and an unlocking position. Weight 38 is supplied with a pin stop 40 to receive shaft pin 34 when shaft 32 is in the set position and weight 38 is in the locking position as illustrated in FIG. 8. A second spring 42 is provided, such as a coil spring, to urge weight 38 into the locking position. An arrow support 44 is coupled with shaft 32 to support arrow 21 until released. A cover 46 is coupled with housing 24 across cavity 26 using mounting screws 47. Cover 46 may be fabricated from a suitable metal or plastic as will be understood by those skilled in the art.

Weight 38 may be an elongated member having at least two lengthwise opposing ends although other weight shapes (such as triangular) are contemplated. In the configuration shown in the drawings, weight 38 is rotatably coupled by pivot pin 58 to housing 24 at one of the opposing ends, such as shown in FIG. 3. Similarly, pin stop 40 is coupled with weight 38 proximate the other of the opposing ends of weight 38, also as shown in FIG. 3. The spaced apart positioning of pivot pin 58 and pin stop 40 reduces the pivotal movement of weight 38 required to effect a release of shaft pin 34. Weight 38 may be fabricated from brass or similar metal.

As shown in FIG. 5, arrow rest 32 may further be supplied with a spring enclosure 60. Spring enclosure 60 is supplied with a shoulder 61 and an elastomeric O-ring 62 for sealing and operational purposes. Spring enclosure 60 may also be supplied with an aperture or other means for securing first spring 36.

Figure 6:
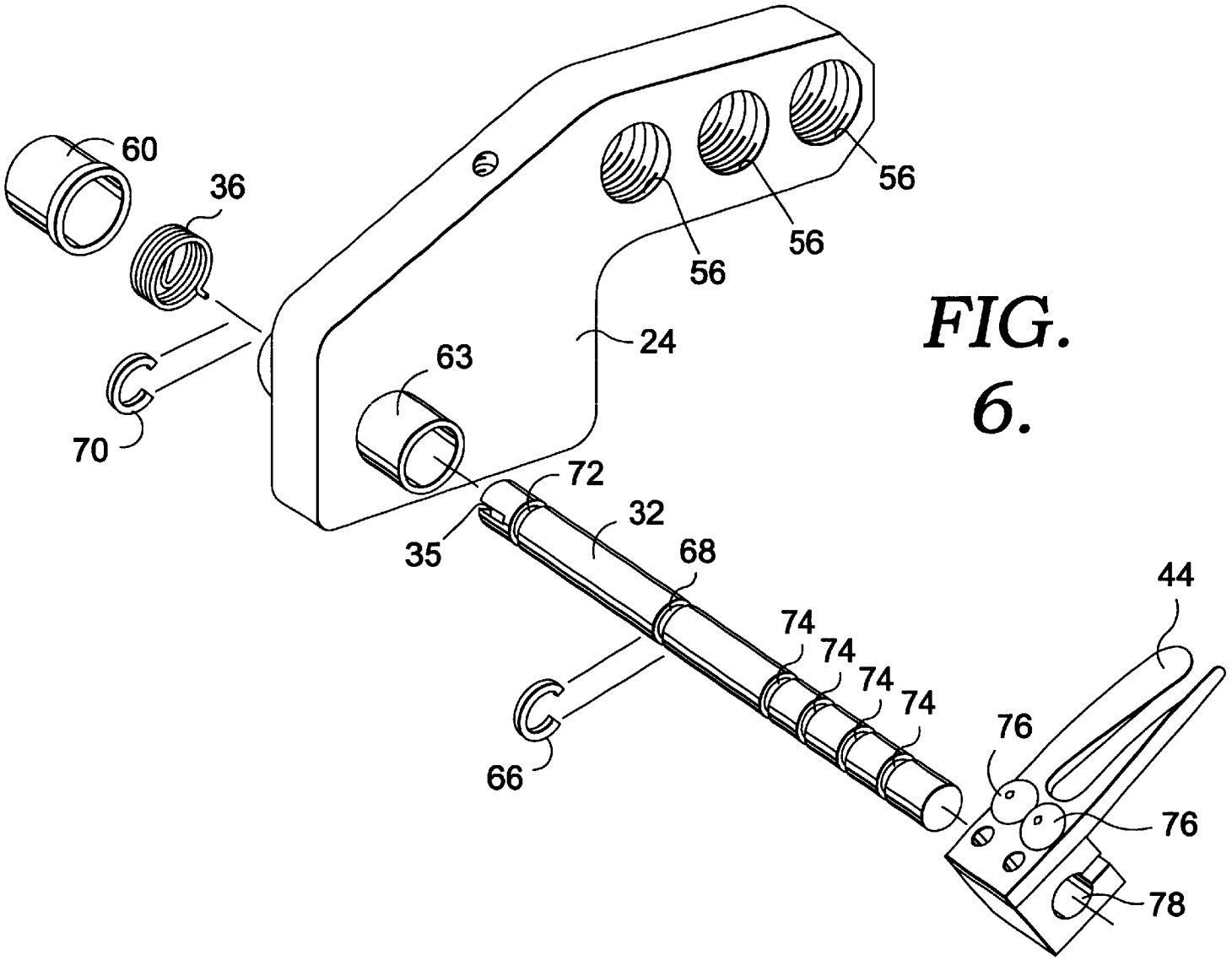
FIG. 6 is an exploded rear perspective of the present invention with the cover not depicted.

A shaft bushing 63 may be provided as illustrated in FIG. 6. Bushing 63 supports shaft 32 and facilitates rotation thereof with less friction. To prevent undesirable lateral movement of shaft 32, shaft 32 may be further supplied with snap ring 66 press-fit in groove 68 as well as snap ring 70 and press-fit in groove 72. Moreover, shaft 32 may be further supplied with aiming groves 74 that enable the archer to better position arrow support 44 along shaft 32 by loosening set screws 76 and moving arrow support 44 to a desired location along shaft 32 and then re-tightening set screws 76.

A first travel stop 48 and a second travel stop 50 are shown in FIG. 3 positioned in cavity 26 on weight 38. First travel stop 48 and second travel stop 50 provide a cushion to prevent weight 38 from contacting the sidewalls of cavity 26, thereby reducing noise and wear. First travel stop 48 and second travel stop 50 may be made of an elastomeric material, such as rubber, as will be understood by those skilled in the art.

Housing 24 contains an aperture 51 for receiving sensitivity adjuster 52 for varying the force applied to second spring 42. As will be understood by those skilled in the art, sensitivity adjuster 52 could be implemented in a variety of ways, such as by a hex-head screw.

Figure 7:
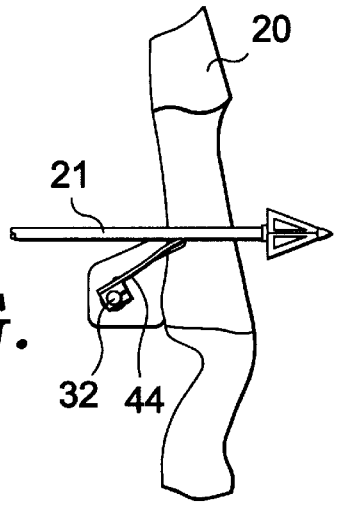
FIG. 7 is a side elevation of the present invention mounted on the archery bow illustrating the present invention supporting an arrow in the set position.

In operation, arrow support 44 is movable between an upward set position and a downward release position. Arrow support 44 is first rotated by the archer upwardly to place arrow rest 22 in the set position. Since arrow support 44 is coupled with shaft 32, shaft 32 likewise rotates to cause shaft pin 34 to move upwardly to contact the underside of pin stop 40. The force exerted by shaft pin 34 on pin stop 40 during the upward rotation causes weight 38 to pivot away from shaft pin 34 and thereby enables shaft pin 34 to bypass pin stop 40 during upward rotation. As soon as shaft pin 34 has bypassed pin stop 40, second spring 42 urges weight 38 back to the locking position. The archer then ceases further upward rotation of arrow support 44. Thereupon, first spring 36 urges shaft 32 to return to the set position, thereby causing shaft pin 34 to rest on pin stop 40. Arrow rest 22 is then in the set position as shown in FIG. 7.

Figure 10:
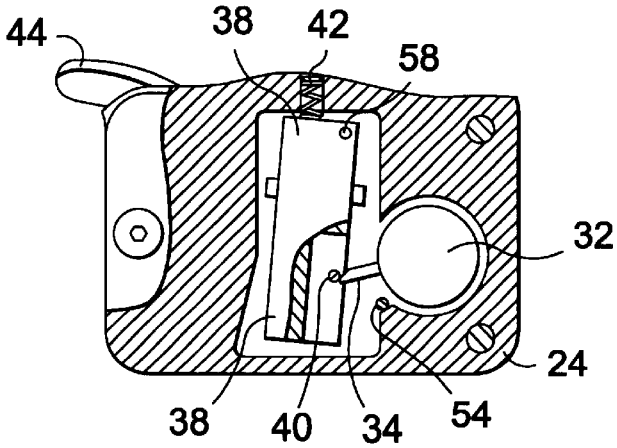
FIG. 10 is a fragmentary side elevation view of the present invention, illustrating a position of the shaft, shaft pin, pin stop and weight shortly after an arrow is released.

After arrow support 44 has been placed in the set position, an arrow 21 is placed thereon. FIG. 8 illustrates a cutaway view of arrow rest 22 when arrow 21 is in the set position shown in FIG. 7. When an arrow is released, the bow experiences a sudden backward movement near the handle. Being coupled with bow 20, housing 24 suddenly moves in the same direction. However, weight 38 is pivotably coupled with housing 24 so that the mass (and its inertia) of weight 38 effectively causes the weight 38 to remain in position as housing 24, shaft 32, and pin 34 move rearwardly. The relative movement between weight 38 and pin 34 results in weight 38 momentarily becoming positioned in the unlocking position, as shown in FIG. 10. Shaft pin 34 is thereby moved away from pin stop 40 and returns to the release position via the rotational force applied by spring 36 to shaft 32. Depending upon the force of the backward movement, second travel stop 50 may cushion weight 38 from the wall of cavity 26. Moreover, sensitivity adjuster 52 may be varied to relieve some of the compressive force applied to second spring 42 in order to ensure a smooth release of shaft pin 34 on lightweight bows.

Figure 9:
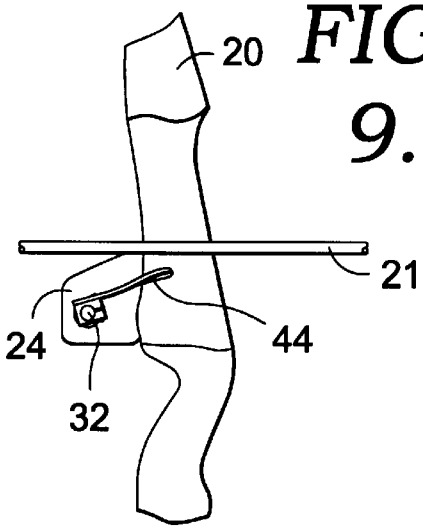
FIG. 9 is a side elevation of the present invention mounted on the archery bow, illustrating the position of the arrow and the arrow support shortly after an arrow is released.
Figure 11:
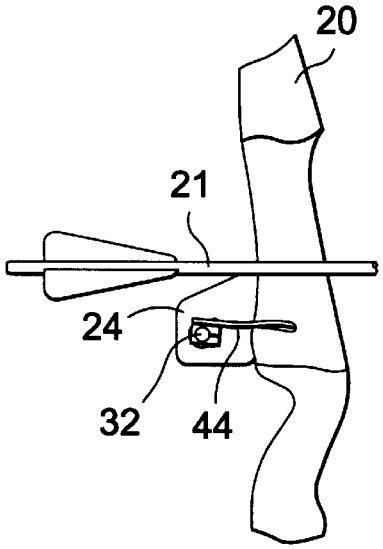
FIG. 11 is a partial side elevation of the present invention mounted on the archery bow, illustrating the release position of the present invention.
Figure 12:
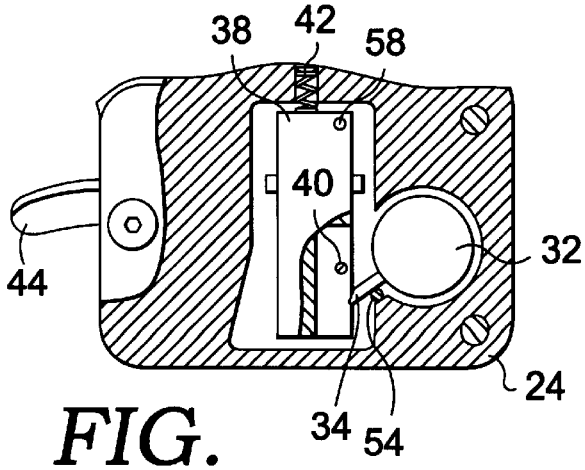
FIG. 12 is a fragmentary side elevation view of the present invention, illustrating the present invention in the release position.

Being biased to the release position, shaft 32 rotates accordingly thereby causing arrow support 44 to begin falling into the release position as shown in FIG. 9. Arrow rest quickly attains the release position as shown in FIGS. 11 and 12 in time for arrow support 44 to avoid the fletching of the released arrow 21 as it clears bow 20.

Alternative embodiments of the present invention become apparent to those skilled in the art to which it pertains upon review of the specification, including the drawing figures. As can be appreciated by those skilled in the art, the present invention provides an improved arrow rest that is less prone to damage during use in the field. In particular, pin stop 40 and shaft pin 34 cooperate to provide the mechanism of arrow rest 22 with a constant starting position that is not affected by the setting of sensitivity adjuster 52 or by the normal wear on the components over time. Providing arrow rest 22 with a constant starting position greatly improves its consistent operation over a large number of arrow releases. The various components shown in FIGS. 1–12 and described in the specification are merely exemplary of those suitable for use in connection with the present invention. Accordingly, the scope of the present invention is defined by the appended Claims rather than the foregoing description.

We claim:

1. An arrow rest for an archery bow, comprising:

a housing having a cavity;

a shaft extending into said housing, said shaft being rotatable between a set position and a release position;

a shaft pin coupled with said shaft, wherein said shaft pin extends away from said shaft and into the cavity to terminate in a distal end;

a first spring positioned to urge said shaft toward the release position;

a weight positioned in the cavity and pivotably coupled with said housing for rotation between a locking position and an unlocking position;

a second spring positioned to urge said weight toward the locking position;

a pin stop coupled with said weight to receive the distal end of said shaft pin when said shaft is in the set position and said weight is in the locking position; and an arrow support coupled with said shaft.

2. The arrow rest of claim 1, further comprising a cover coupled with said housing across the cavity.

3. The arrow rest of claim 1, further comprising:

a first travel stop positioned within the cavity to limit the rotation of said weight when rotating in the direction of the locking position; and a second travel stop positioned within the cavity to limit the rotation of said weight when rotating in the direction of the unlocking position.

4. The arrow rest of claim 1, further comprising:

a sensitivity adjuster to variably compress said second spring and thereby to vary the force applied by said second spring to said weight.

5. The arrow rest of claim 1, wherein a top edge of the distal end of said shaft pin is recessed away from the distal end along the longitudinal axis of said shaft pin.

6. The arrow rest of claim 1, further comprising:

means for coupling the arrow rest to the archery bow.

7. The arrow rest of claim 1, wherein said weight is elongated having at least two lengthwise opposing ends, said weight being rotatably coupled with said housing proximate one of said opposing ends and wherein said pin stop is coupled with said weight proximate the other of said opposing ends.

8. The arrow rest of claim 1, further comprising:

a shaft cover adjacent said housing and enclosing a portion of said shaft.

9. An arrow rest for an archery bow, comprising:

a housing having a cavity;

a shaft extending into said housing, said shaft being rotatable between a set position and a release position;

a shaft enclosure adjacent said housing and covering a portion of said shaft;

a shaft pin coupled with said shaft, wherein said shaft pin extends away from said shaft and into the cavity to terminate in a distal end, a first spring for urging said shaft toward the release position;

a weight positioned in the cavity and pivotably coupled with said housing for rotation between a locking position and an unlocking position;

a second spring for urging said weight toward the locking position;

a pin stop coupled with said weight to receive the distal end of said shaft pin when said shaft is in the set position and said weight is in the locking position; and an arrow support coupled with said shaft.

10. The arrow rest of claim 9, further comprising:

a cover coupled with said housing across the cavity.

11. The arrow rest of claim 9, further comprising:

a sensitivity adjuster to variably compress said second spring and thereby to vary the force applied by said second spring to said weight.

12. The arrow rest of claim 9, wherein a top edge of the distal end of said shaft pin is recessed away from the distal end along the longitudinal axis of said shaft pin.

13. The arrow rest of claim 9, further comprising:

means for coupling the arrow rest to the archery bow.

14. The arrow rest of claim 9, wherein said weight is elongated having at least two lengthwise opposing ends, said weight being rotatably coupled with said housing proximate one of said opposing ends and wherein said pin stop is coupled with said weight proximate the other of said opposing ends.

15. An arrow rest for an archery bow, said arrow rest comprising:

an arrow support mounted on a rotatable shaft;

a housing;

means enclosed within said housing for enabling movement of said arrow support between a set position which supports an archery arrow thereon and a release position which has no contact with said arrow, said enclosed means including an inertia responsive means for effecting arrow support movement upon preselected movement of said bow; and means for hanging said inertia responsive means within said housing.

16. The arrow rest of claim 15, wherein said bow is capable of shooting an arrow therefrom by releasing the arrow when mounted on said arrow support, said arrow having a fletching thereon, said inertia responsive means and said enclosed means cooperating to move said arrow support away from said arrow so as to eliminate contact with the arrow fletching once the arrow is released.

17. The arrow rest of claim 16, wherein said shaft is rotatably mounted within said housing with a portion thereof extending outwardly therefrom, said arrow support being mounted on the outwardly extending shaft portion.

18. The arrow rest of claim 17, wherein said inertia responsive means includes a weight pivotally mounted to said housing.

19. The arrow rest of claim 18, further comprising:

means interconnecting said weight to said shaft for locating said shaft and arrow support in said set position.

20. The arrow rest of claim 18, further comprising:

means for releasably interconnecting said weight to said shaft for facilitating movement of said shaft and said arrow support to said release position.

* * * * *